US006202354B1

(12) United States Patent
Kirby

(10) Patent No.: US 6,202,354 B1
(45) Date of Patent: Mar. 20, 2001

(54) SKI SLOPE OBSTACLE INJURY PROTECTING SYSTEM

(76) Inventor: Jake Kirby, 8101 Camino Media #87, Bakersfield, CA (US) 93311

( * ) Notice: Subject to any disclaimer, the term of this patent is extended or adjusted under 35 U.S.C. 154(b) by 0 days.

(21) Appl. No.: 09/335,170

(22) Filed: Jun. 17, 1999

(51) Int. Cl.[7] ..... E04D 1/34
(52) U.S. Cl. ..... 52/4
(58) Field of Search ..... 52/736.1, 736.3, 52/736.4, 4; 47/23

(56) References Cited

U.S. PATENT DOCUMENTS 1,123,657 * 1/1915 Bache ..... 135/93
1,282,677 * 10/1918 Comstock ..... 47/23 X
2,879,780 * 3/1959 Arbore ..... 135/4
3,406,698 * 10/1968 Hutchison ..... 135/1
3,945,106 * 3/1976 Mayr et al. ..... 29/429
4,596,106 * 6/1986 Kunczynski ..... 52/728
4,922,942 * 5/1990 Schaeffer ..... 135/90
5,197,506 * 3/1993 Morin ..... 135/118
5,809,689 * 9/1998 Mathur ..... 47/23

* cited by examiner

*Primary Examiner*—Matthew C. Graham
*Assistant Examiner*—Benjamin A. Pezzlo

(57) ABSTRACT

A ski slope obstacle injury protecting system for protecting a skier from injury when colliding into an obstacle on a ski slop such as a pole or tree. The ski slope obstacle injury protecting system includes an annular mounting collar designed for mounting around an obstacle upwardly extending from a ground surface. A plurality of elongate upper flexible elements are extended from the mounting collar. A generally frusta-conical trampoline is provided having annular top and bottom edges. The upper flexible elements are coupled to the top edge of the trampoline. A plurality of elongate lower flexible elements are extended from the bottom edge of the trampoline and are designed for securing the bottom edge of the trampoline to the ground surface.

13 Claims, 2 Drawing Sheets

SKI SLOPE OBSTACLE INJURY PROTECTING SYSTEM

BACKGROUND OF THE INVENTION

1. Field of the Invention

The present invention relates to ski slope obstacle injury protecting systems and more particularly pertains to a new ski slope obstacle injury protecting system for protecting a skier from injury when colliding into an obstacle on a ski slop such as a pole or tree.

2. Description of the Prior Art

The use of ski slope obstacle injury protecting systems is known in the prior art. More specifically, ski slope obstacle injury protecting systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,104,875; U.S. Pat. No. 4,198,036; U.S. Pat. No. 3,831,941; U.S. Pat. No. 2,734,739; U.S. Pat. No. 3,997,150; and Des. U.S. Pat. No. 380,274.

While these devices fulfill their respective, particular objectives and requirements, the aforementioned patents do not disclose a new ski slope obstacle injury protecting system. The inventive device includes an annular mounting collar designed for mounting around an obstacle upwardly extending from a ground surface. A plurality of elongate upper flexible elements are extended from the mounting collar. A generally frusta-conical trampoline is provided having annular top and bottom edges. The upper flexible elements is coupled to the top edge of the trampoline. A plurality of elongate lower flexible elements are extended from the bottom edge of the trampoline and are designed for securing the bottom edge of the trampoline to the ground surface.

In these respects, the ski slope obstacle injury protecting system according to the present invention substantially departs from the conventional concepts and designs of the prior art, and in so doing provides an apparatus primarily developed for the purpose of protecting a skier from injury when colliding into an obstacle on a ski slop such as a pole or tree.

SUMMARY OF THE INVENTION

In view of the foregoing disadvantages inherent in the known types of ski slope obstacle injury protecting systems now present in the prior art, the present invention provides a new ski slope obstacle injury protecting system construction wherein the same can be utilized for protecting a skier from injury when colliding into an obstacle on a ski slop such as a pole or tree.

The general purpose of the present invention, which will be described subsequently in greater detail, is to provide a new ski slope obstacle injury protecting system apparatus and method which has many of the advantages of the ski slope obstacle injury protecting systems mentioned heretofore and many novel features that result in a new ski slope obstacle injury protecting system which is not anticipated, rendered obvious, suggested, or even implied by any of the prior art ski slope obstacle injury protecting systems, either alone or in any combination thereof.

To attain this, the present invention generally comprises an annular mounting collar designed for mounting around an obstacle upwardly extending from a ground surface. A plurality of elongate upper flexible elements are extended from the mounting collar. A generally frusta-conical trampoline is provided having annular top and bottom edges. The upper flexible elements are coupled to the top edge of the trampoline. A plurality of elongate lower flexible elements are extended from the bottom edge of the trampoline and are designed for securing the bottom edge of the trampoline to the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski slope obstacle injury protecting system apparatus and method which has many of the advantages of the ski slope obstacle injury protecting systems mentioned heretofore and many novel features that result in a new ski slope obstacle injury protecting system which is not anticipated, rendered obvious, suggested, or even implied by any of the prior art ski slope obstacle injury protecting systems, either alone or in any combination thereof.

It is another object of the present invention to provide a new ski slope obstacle injury protecting system which may be easily and efficiently manufactured and marketed.

It is a further object of the present invention to provide a new ski slope obstacle injury protecting system which is of a durable and reliable construction.

An even further object of the present invention is to provide a new ski slope obstacle injury protecting system which is susceptible of a low cost of manufacture with regard to both materials and labor, and which accordingly is then susceptible of low prices of sale to the consuming public, thereby making such ski slope obstacle injury protecting system economically available to the buying public.

Still yet another object of the present invention is to provide a new ski slope obstacle injury protecting system which provides in the apparatuses and methods of the prior art some of the advantages thereof, while simultaneously overcoming some of the disadvantages normally associated therewith.

Still another object of the present invention is to provide a new ski slope obstacle injury protecting system for protecting a skier from injury when colliding into an obstacle on a ski slop such as a pole or tree.

Yet another object of the present invention is to provide a new ski slope obstacle injury protecting system which includes an annular mounting collar designed for mounting around an obstacle upwardly extending from a ground surface. A plurality of elongate upper flexible elements are extended from the mounting collar. A generally frusta-conical trampoline is provided having annular top and bottom edges. The upper flexible elements is coupled to the top edge of the trampoline. A plurality of elongate lower flexible elements are extended from the bottom edge of the trampoline and are designed for securing the bottom edge of the trampoline to the ground surface.

Still yet another object of the present invention is to provide a new ski slope obstacle injury protecting system that provides a resilient cushion to a skier colliding into an obstacle so that the force of the collision is absorbed by the protecting system and not the user thereby helping protect the skier from serious injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
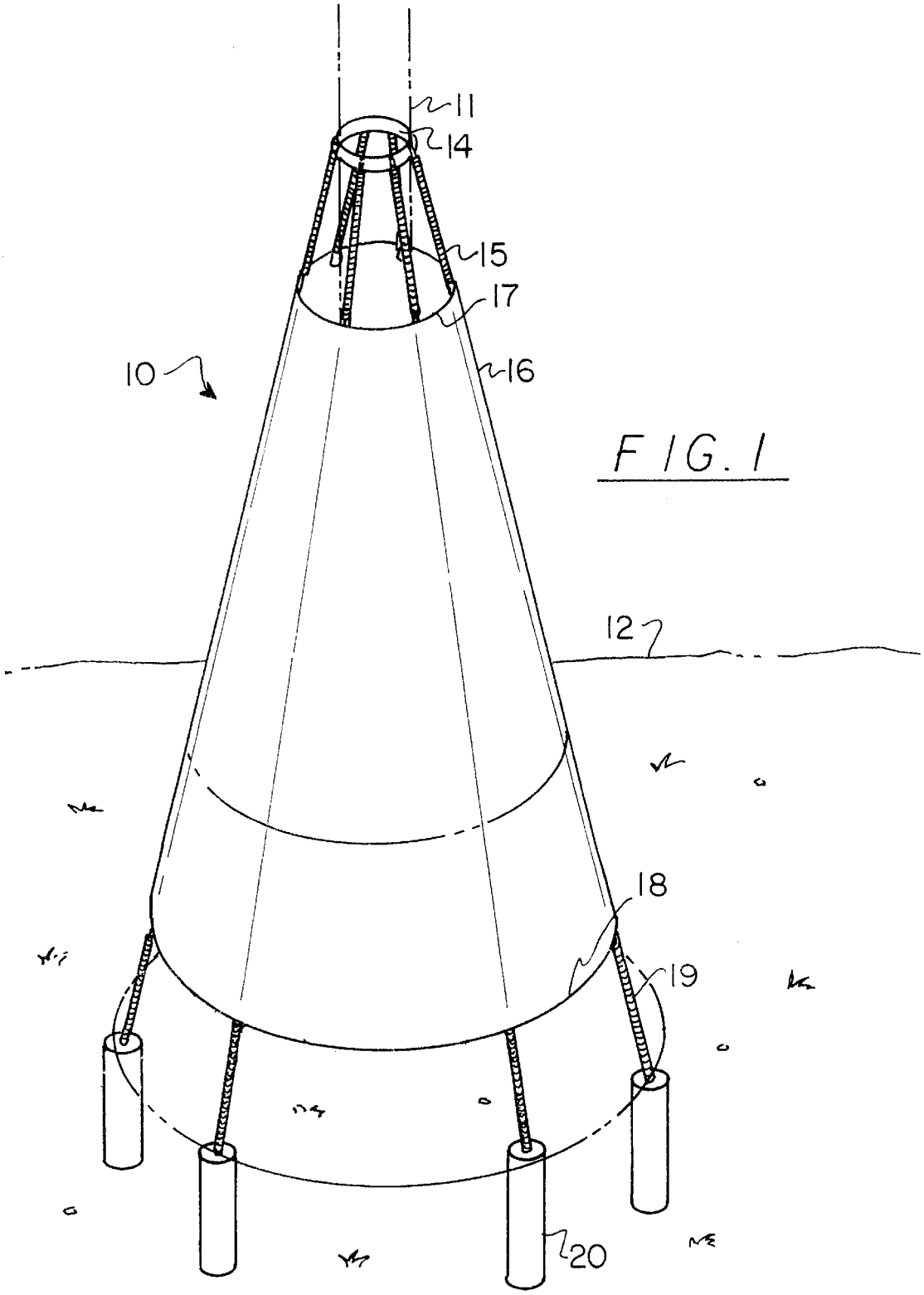
FIG. 1 is a schematic perspective view of a new ski slope obstacle injury protecting system according to the present invention.
Figure 2:
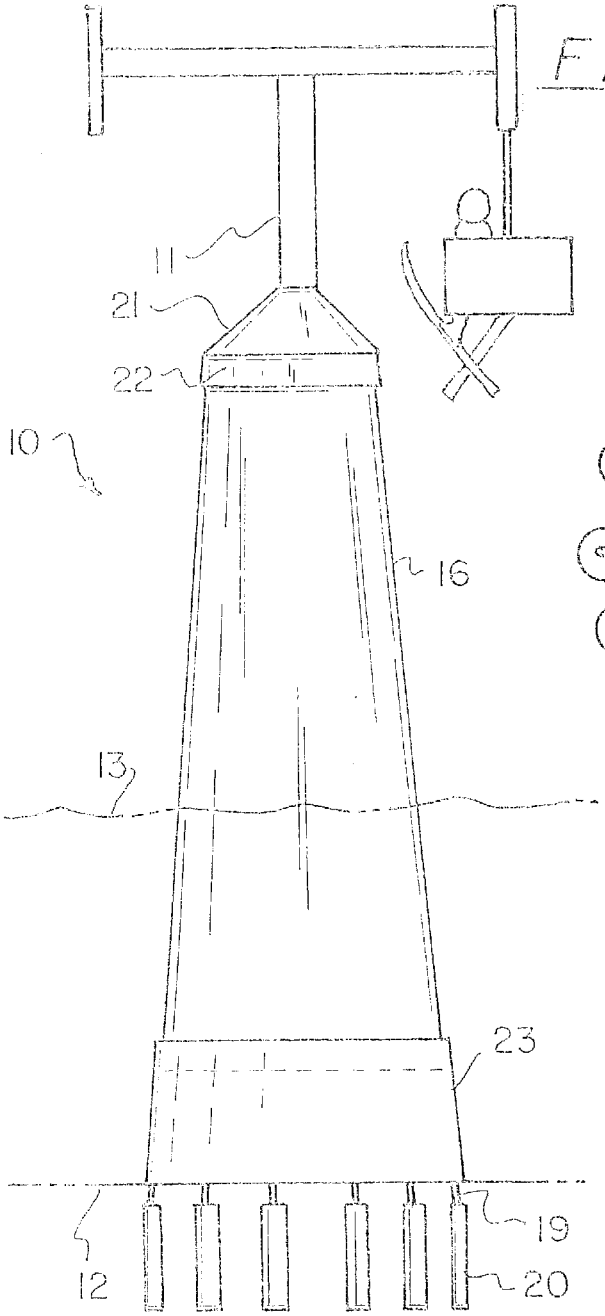
FIG. 2 is a schematic side view of the present invention around a column of a chair-lift.
Figure 3:
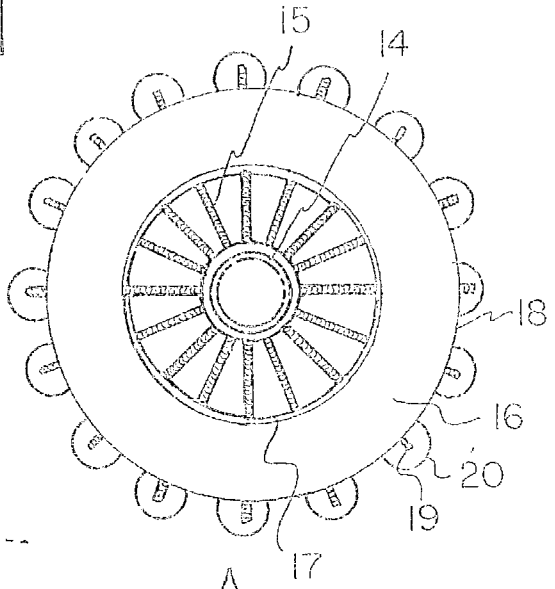
FIG. 3 is a schematic top view of the present invention.
Figure 4:
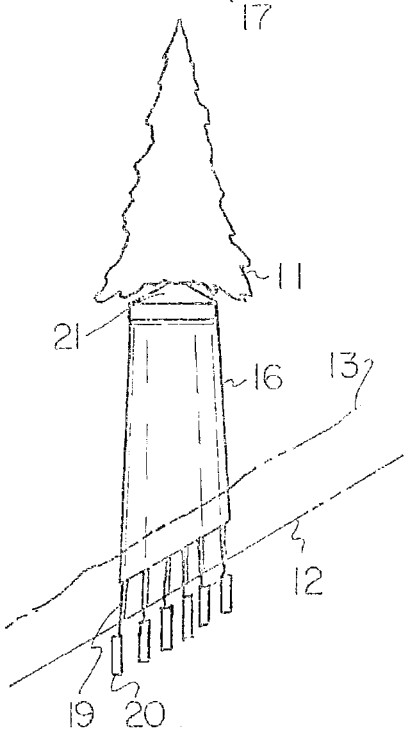
FIG. 4 is another schematic side view of the present invention around a tree.

With reference now to the drawings, and in particular to FIGS. 1 through 4 thereof, a new ski slope obstacle injury protecting system embodying the principles and concepts of the present invention and generally designated by the reference numeral 10 will be described.

As best illustrated in FIGS. 1 through 4, the ski slope obstacle injury protecting system 10 generally comprises an annular mounting collar designed for mounting around an obstacle upwardly extending from a ground surface. A plurality of elongate upper flexible elements are extended from the mounting collar. A generally frusta-conical trampoline is provided having annular top and bottom edges. The upper flexible elements are coupled to the top edge of the trampoline. A plurality of elongate lower flexible elements are extended from the bottom edge of the trampoline and are designed for securing the bottom edge of the trampoline to the ground surface.

The protecting system 10 is designed for protecting a skier from injury when colliding into an obstacle 11 upwardly extending from a ground surface 12 defining a ski slope with snow thereon forming a skiing surface 13. Common obstacles include, for example, a tree trunk, a post or a chair-lift column.

An annular mounting collar 14 is disposed about the obstacle and spaced above the ground surface. A plurality of elongate upper flexible elements 15 are downwardly extended from the mounting collar such that the upper elongate elements outwardly and downwardly radiate from the obstacle. The upper flexible elements each have opposite upper and lower ends. The upper ends of the upper flexible elements are coupled to the mounting collar. The upper ends of the upper flexible elements are preferably spaced apart at substantially equal intervals along the mounting collar for optimal durability of the system.

A generally frusta-conical trampoline 16 is disposed around the obstacle between the mounting collar and the ski slope. The trampoline has annular top and bottom edges 17,18. The trampoline preferably comprises a flexible fabric material such as, for example, a canvas material for helping to resiliently absorb the impact of a skier colliding thereagainst. The lower ends of the upper flexible elements are coupled to the top edge of the trampoline such that the trampoline depends from the mounting collar by the upper flexible elements. The lower ends of the upper flexible elements are preferably spaced apart at substantially equal intervals along the top edge of the trampoline for optimal durability.

The bottom edge of the trampoline is spaced above the ground surface and positioned beneath the skiing surface formed by the snow on the ground surface. This allows air to circulate beneath the trampoline in the off-season or summertime when no snow is on the ground.

A plurality of elongate lower flexible elements 19 are downwardly extended from the bottom edge of the trampoline towards the ground surface through the snow. The lower flexible elements each have opposite upper and lower ends. The upper ends of the lower flexible elements are coupled to the bottom edge of the trampoline. The upper ends of the lower flexible elements are preferably spaced apart at substantially equal intervals along the bottom edge of the trampoline for optimal durability.

The lower ends of the lower flexible elements each have a anchor 20 coupled thereto. The anchors preferably comprise a concrete material so that the anchors can be formed into any suitable shape including a cylindrical shape as shown in the Figures. The anchors are inserted into the ground surface to anchor the lower ends of the lower flexible elements to the ground surface. Preferably, the anchors are arranged in a spaced apart ring around a base of the obstacle with the anchors spaced apart at substantially equal intervals in the ring of anchors for optimal securing of the anchors in the ground for holding the trampoline taut.

Ideally, the upper and lower flexible elements each comprise an elongate resiliently deflectable coiled spring. The upper and lower flexible elements pull the trampoline taut between the mounting collar and the anchors so that the trampoline is of sufficient tension to resiliently deform and bounce back when struck much as the jumping canvas of a traditional horizontal trampoline used for jumping on. In use, when a skier collides into the trampoline, the trampoline and the flexible elements deform and flex to absorb the impact of the collision. This way, the skier absorbs less of the force of the collision and thereby avoids injury that would have happened had the skier directly collided with the obstacle.

In a preferred embodiment, a generally frusta-conical tent 21 is coupled to the mounting collar and disposed around the obstacle. The tent substantially covers the upper flexible elements and a top opening defined by the top edge of the trampoline. The tent comprises a fabric material such as, for example, a canvas or nylon material. In use, the tent is designed for preventing snow and other precipitation from falling into the space between the trampoline and the obstacle which if fell in sufficient quantities could limit the space in which the trampoline moves when it gives when impacted by a skier colliding thereagainst. Ideally, the tent has a generally cylindrical lower flap 22 downwardly depending therefrom around the top edge of the trampoline to help ensure that no snow blows into the top opening of the trampoline.

Also ideally, a generally frusta-conical skirt 23 is disposed around the obstacle beneath the snow and between the bottom edge of the trampoline and the ground surface such that the skirt substantially covers the lower flexible elements. The skirt has an annular upper edge coupled to the trampoline such that the skirt depends from the trampoline. Like the tent, the skirt also comprises a fabric material such as, for example, a canvas or nylon material. In use, the skirt is designed for preventing snow and other objects from accumulating beneath the trampoline and also for preventing injury during low snow conditions when the bottom edge and portions of the lower flexible elements are exposed above the snow surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protection system for protecting a skier from injury when colliding into an obstacle upwardly extending from a ski slope, said protection system comprising:

an annular mounting collar adapted for mounting around an obstacle upwardly extending from a ground surface;

a plurality of elongate upper flexible elements being extended from said mounting collar;

a generally frusta-conical trampoline being adapted for extending around the obstacle between the mounting collar and the ground surface;

said trampoline having annular top and bottom edges;

said upper flexible elements being coupled to said top edge of said trampoline;

a plurality of elongate lower flexible elements being extended from said bottom edge of said trampoline;

said lower flexible elements being adapted for securing to the ground surface; and wherein said upper and lower flexible elements each comprise an elongate resiliently deflectable coiled spring.

2. The protective system of claim 1, wherein said lower flexible elements each have an anchor coupled thereto, said anchors being adapted for insertion into the ground surface to secure said lower flexible elements to said ground surface.

3. The protective system of claim 1, further comprising a tent being coupled to said mounting collar, said tent substantially covering said upper flexible elements and a top opening defined by said top edge of said trampoline.

4. The protective system of claim 1, wherein said tent has a lower flap extending around said top edge of said trampoline.

5. The protective system of claim 1, further comprising a skirt substantially covering said lower flexible elements.

6. The protective system of claim 5, wherein said skirt is coupled to said trampoline.

7. A protection system, comprising:

an obstacle upwardly extending from a ground surface defining a ski slope, said ground surface having snow thereon forming a skiing surface;

an annular mounting collar being disposed about said obstacle and spaced above said ground surface;

a plurality of elongate upper flexible elements being downwardly extended from said mounting collar such that said upper elongate elements outwardly radiate from said obstacle;

said upper flexible elements each having opposite upper and lower ends, said upper ends of said upper flexible elements being coupled to said mounting collar;

said upper ends of said upper flexible elements being spaced apart at substantially equal intervals along said mounting collar;

a generally frusta-conical trampoline being disposed around said obstacle between said mounting collar and said ski slope;

said trampoline having annular top and bottom edges, said trampoline comprising a flexible fabric material;

said lower ends of said upper flexible elements being coupled to said top edge of said trampoline such that said trampoline depends from said mounting collar;

said lower ends of said upper flexible elements being spaced apart at substantially equal intervals along said top edge of said trampoline;

said bottom edge of said trampoline being spaced above said ground surface and positioned beneath said skiing surface;

a plurality of elongate lower flexible elements being downwardly extended from said bottom edge of said trampoline towards said ground surface;

said lower flexible elements each having opposite upper and lower ends, said upper ends of said lower flexible elements being coupled to said bottom edge of said trampoline;

said upper ends of said lower flexible elements being spaced apart at substantially equal intervals along said bottom edge of said trampoline;

said lower ends of said lower flexible elements each having a generally cylindrical anchor coupled thereto;

said anchors being inserted into said ground surface to anchor said lower ends of said lower flexible elements to said ground surface;

wherein said upper and lower flexible elements each comprise an elongate resiliently deflectable coiled spring;

a generally frusta-conical tent being coupled to said mounting collar and disposed around said obstacle, said tent substantially covering said upper flexible elements and a top opening defined by said top edge of said trampoline;

said tent having a generally cylindrical lower flap downwardly depending therefrom around said top edge of said trampoline;

a generally frusta-conical skirt being disposed around said obstacle between said bottom edge of said trampoline and said ground surface such that said skirt substantially covers said lower flexible elements, said skirt having an annular upper edge coupled to said trampoline.

8. A protection system for protecting a skier from injury when colliding into an obstacle upwardly extending from a ski slope, said protection system comprising:

an annular mounting collar adapted for mounting around an obstacle upwardly extending from a ground surface;

a plurality of elongate upper flexible elements being extended from said mounting collar;

a generally frusta-conical trampoline being adapted for extending around the obstacle between the mounting collar and the ground surface;

said trampoline having annular top and bottom edges;

said upper flexible elements being coupled to said top edge of said trampoline;

a plurality of elongate lower flexible elements being extended from said bottom edge of said trampoline;

said lower flexible elements being adapted for securing to the ground surface; and said upper and lower flexible elements each comprising an elongate spring.

9. The protective system of claim 8, wherein said lower flexible elements each have an anchor coupled thereto, said anchors being adapted for insertion into the ground surface to secure said lower flexible elements to said ground surface.

10. The protective system of claim 8, further comprising a tent being coupled to said mounting collar, said tent substantially covering said upper flexible elements and a top opening defined by said top edge of said trampoline.

11. The protective system of claim 8, wherein said tent has a lower flap extending around said top edge of said trampoline.

12. The protective system of claim 8, further comprising a skirt substantially covering said lower flexible elements.

13. The protective system of claim 12, wherein said skirt is coupled to said trampoline.

* * * * *